US008878743B1

(12) United States Patent
Buchanan et al.

(10) Patent No.: US 8,878,743 B1
(45) Date of Patent: Nov. 4, 2014

(54) STEPPED RADIO FREQUENCY REFLECTOR ANTENNA

(75) Inventors: Alan M. Buchanan, Salt Lake City, UT (US); Trevis D. Anderson, Salt Lake City, UT (US); Douglas H. Ulmer, Salt Lake City, UT (US); Jeffrey J. McGill, Salt Lake City, UT (US); Scott M. Lyon, Salt Lake City, UT (US); Rory K. Sorensen, Salt Lake City, UT (US); Neil K. Harker, Salt Lake City, UT (US)

(73) Assignee: L-3 Communications Corp., New York, NY (US)

( * ) Notice: Subject to any disclaimer, the term of this patent is extended or adjusted under 35 U.S.C. 154(b) by 187 days.

(21) Appl. No.: 13/535,877

(22) Filed: Jun. 28, 2012

(51) Int. Cl.
*H01Q 19/15* (2006.01)
*H01Q 19/19* (2006.01)

(52) U.S. Cl.
CPC ..... *H01Q 19/15* (2013.01); *H01Q 19/19* (2013.01)
USPC ..... 343/837; 343/779

(58) Field of Classification Search
CPC ..... H01Q 3/01; H01Q 3/08; H01Q 19/12; H01Q 19/15; H01Q 19/19
USPC ..... 343/912, 914, 840, 779, 837
See application file for complete search history.

(56) References Cited

U.S. PATENT DOCUMENTS

| | | | | |
|---|---|---|---|---|
| 1,906,546 | A * | 5/1933 | Darbord | 343/840 |
| 3,108,279 | A * | 10/1963 | Eisentraut | 343/775 |
| 4,058,812 | A | 11/1977 | Stanislaw | |
| 4,513,293 | A * | 4/1985 | Stephens | 343/840 |
| 4,825,223 | A * | 4/1989 | Moore | 343/840 |
| 5,512,913 | A * | 4/1996 | Staney | 343/781 P |
| 5,606,334 | A * | 2/1997 | Amarillas et al. | 343/840 |
| 6,281,852 | B1 * | 8/2001 | Amarillas | 343/725 |
| 6,285,332 | B1 * | 9/2001 | Chandler | 343/756 |
| 7,084,836 | B2 * | 8/2006 | Espenscheid et al. | 343/914 |
| 7,280,081 | B2 * | 10/2007 | Mahr | 343/781 CA |
| 7,737,903 | B1 | 6/2010 | Rao et al. | |
| 2001/0045910 | A1 | 11/2001 | Gau et al. | |
| 2010/0060546 | A1 | 3/2010 | Robson et al. | |
| 2011/0050526 | A1 | 3/2011 | Tolleson, Jr. et al. | |

OTHER PUBLICATIONS

Moreira et al.. "Generalized Classical Axially Symmetric Dual-Reflector Antennas," IEEE Transactions on Antennas and Propagation, vol. 49, No. 4 (Apr. 2001), pp. 547-554.

* cited by examiner

*Primary Examiner* — Hoanganh Le
(74) *Attorney, Agent, or Firm* — Kirton McConkie

(57) ABSTRACT

Stepped radio frequency (RF) reflector antennas are disclosed in which an inner RF reflector is disposed in a central opening of at one or more annular RF reflectors. The RF reflecting surface of the inner RF reflector and the RF reflecting surface(s) of the one or more annular RF reflectors can be shaped and positioned relative to each other to have different focal lengths but nevertheless reflect an RF signal to the same focal plane. The depth of the inventive reflector antenna system can be less than the depth of prior art reflector antennas with a comparable RF aperture.

20 Claims, 9 Drawing Sheets

Prior Art

Prior Art

STEPPED RADIO FREQUENCY REFLECTOR ANTENNA

BACKGROUND

The present invention relates generally to the field of radio frequency (RF) reflector antennas.

FIGS. 1, 2A, and 2B illustrate a typical prior art reflector-type antenna system 100 comprising a main RF reflector antenna 102 and an RF sub-reflector 108, which is attached to the main reflector antenna 102 by support structures 112. As shown in FIG. 2A, the main reflector antenna 102 comprises an RF reflecting surface 104 that reflects an RF signal 202 between the main reflector 102 and the sub-reflector 108.

Referring to FIG. 1, an outgoing RF signal 202 is provided through an RF signal feed 110 to the sub-reflector 108, which reflects the RF signal 202 to the RF reflecting surface 104 of the main reflector 102. The main reflector 102 reflects the RF signal 202 away from the antenna system 100 (e.g., toward a remotely located receiving antenna (not shown)).

In incoming RF signal 202 travels a reverse direction. That is, an incoming RF signal 202 (e.g., from a remotely located transmitting antenna (not shown)) arrives at the antenna system 100 and is reflected from the RF reflecting surface 104 of the main reflector 102 to the sub-reflector 108, which reflects the RF signal 202 into the signal feed 110.

Typically, the RF reflecting surface 104 is curved to reflect the RF signal 202 to and from a focal area 210 (see FIGS. 2A and 2B) on the sub-reflector 108. The RF aperture 212 of the main reflector antenna 102 is related to its depth 216. The larger the aperture 212 the larger the depth 216. Thus, to increase the aperture 212 of a given antenna system 102, the depth 216 of the main reflector antenna 102 must be correspondingly increased.

Some embodiments of the present invention allow for an increased RF aperture of a reflector antenna system without a corresponding large increase in depth of the main reflector. This and other advantages can be provided by some embodiments of the invention.

SUMMARY

In some embodiments of the invention, a radio frequency (RF) reflector antenna system can include an inner RF reflector antenna and a first annular RF reflector antenna. The inner RF reflector antenna can have an RF reflecting surface with a first focal length to a focal plane, and the first annular RF reflector antenna can have a first annular RF reflecting surface with a second focal length to the focal plane. The inner reflector can be disposed in a central opening of the annular reflector antenna, and the first focal length of the inner reflector can be different than the second focal length of the first annular RF reflector antenna.

DETAILED DESCRIPTION OF EXEMPLARY EMBODIMENTS

This specification describes exemplary embodiments and applications of the invention. The invention, however, is not limited to these exemplary embodiments and applications or to the manner in which the exemplary embodiments and applications operate or are described herein. Moreover, the Figures may show simplified or partial views, and the dimensions of elements in the Figures may be exaggerated or otherwise not in proportion for clarity. In addition, as the terms "on," "attached to," or "coupled to" are used herein, one object (e.g., a material, a layer, a substrate, etc.) can be "on," "attached to," or "coupled to" another object regardless of whether the one object is directly on, attached, or coupled to the other object or there are one or more intervening objects between the one object and the other object. Also, directions (e.g., above, below, top, bottom, side, up, down, under, over, upper, lower, horizontal, vertical, "x," "y," "z," etc.), if provided, are relative and provided solely by way of example and for ease of illustration and discussion and not by way of limitation. In addition, where reference is made to a list of elements (e.g., elements a, b, c), such reference is intended to include any one of the listed elements by itself, any combination of less than all of the listed elements, and/or a combination of all of the listed elements.

As used herein, "substantially" means sufficient to work for the intended purpose. The term "ones" means more than one.

The abbreviation "RF" means radio frequency, and when used to describe a structure or element, means that the structure or element is configured for RF signals. The "RF aperture" of an RF reflector antenna is the effective opening to and from the antenna for incoming and outgoing RF signals. The "vertex" of a parabolic RF reflector antenna or a paraboloidal surface of an RF reflector antenna is the innermost point at the center of the parabolic reflector or the paraboloidal surface. The term "space," as used herein, means a medium into which an RF signal is transmitted and includes the earth's atmosphere.

Some embodiments of the invention are directed to a stepped RF main reflector antenna system in which an inner RF reflector is disposed in a central opening of at one or more annular RF reflectors. The RF reflecting surface of the inner RF reflector and the RF reflecting surface(s) of the one or more annular RF reflectors can be shaped and positioned relative to each other to have different focal lengths but nevertheless reflect an RF signal to the same focal plane. The depth of the inventive reflector antenna system can be less than the depth of prior art reflector antennas with a comparable RF aperture.

Figure 1:
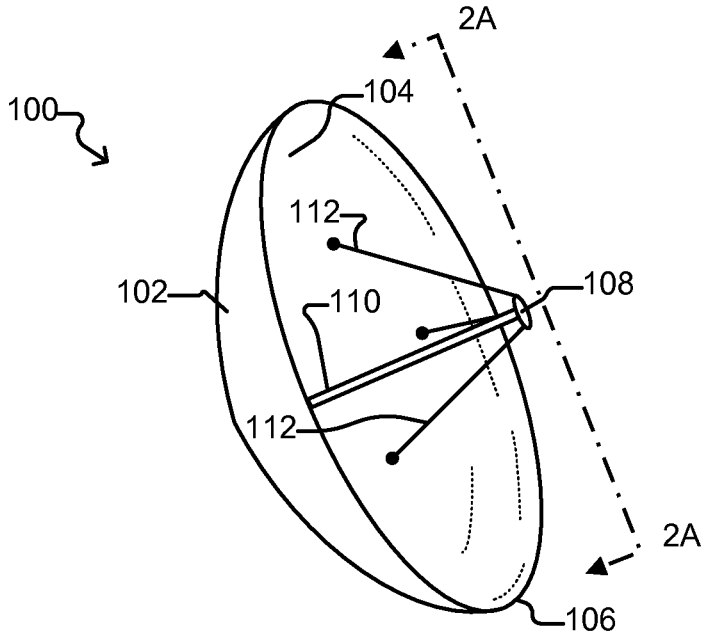
FIG. 1 illustrates a typical prior art reflector antenna system.
Figure 2A:
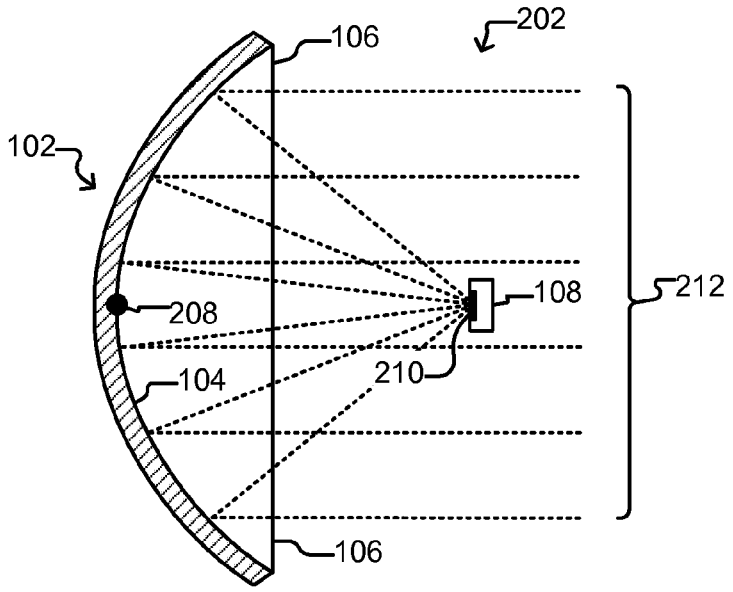
FIGS. 2A and 2B show a cross-sectional, side view of the reflector antenna system of FIG. 1.
Figure 2B:
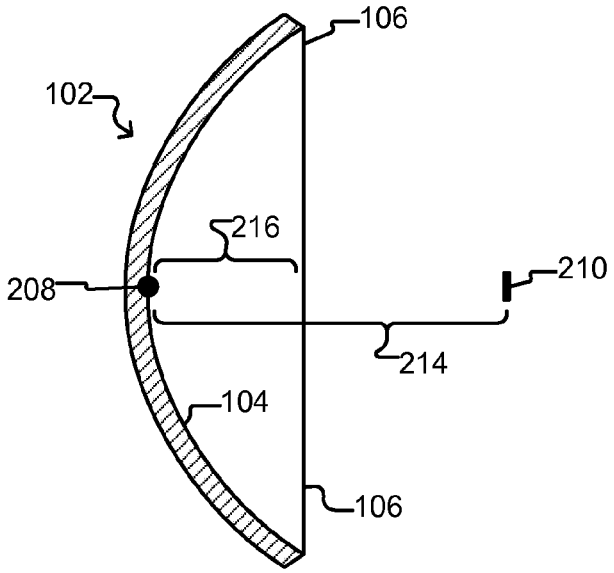
Prior Art Figure 2B
Figure 3A:
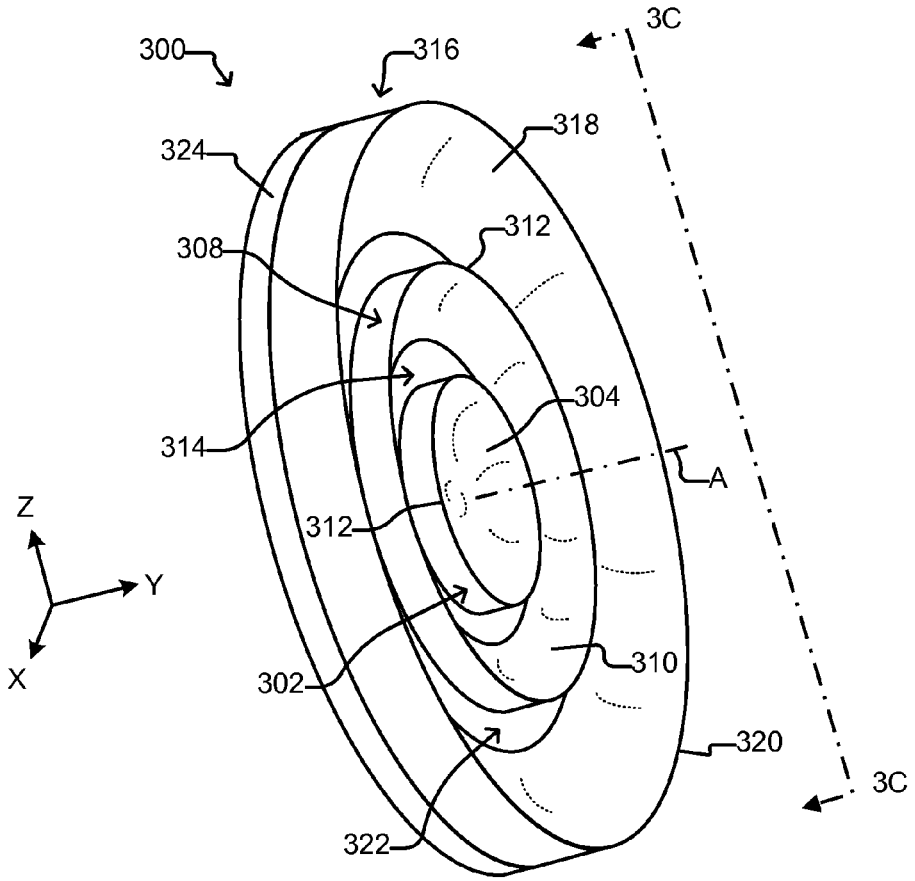
FIG. 3A shows a perspective view of a stepped main reflector RF antenna according to some embodiments of the invention.
Figure 3B:
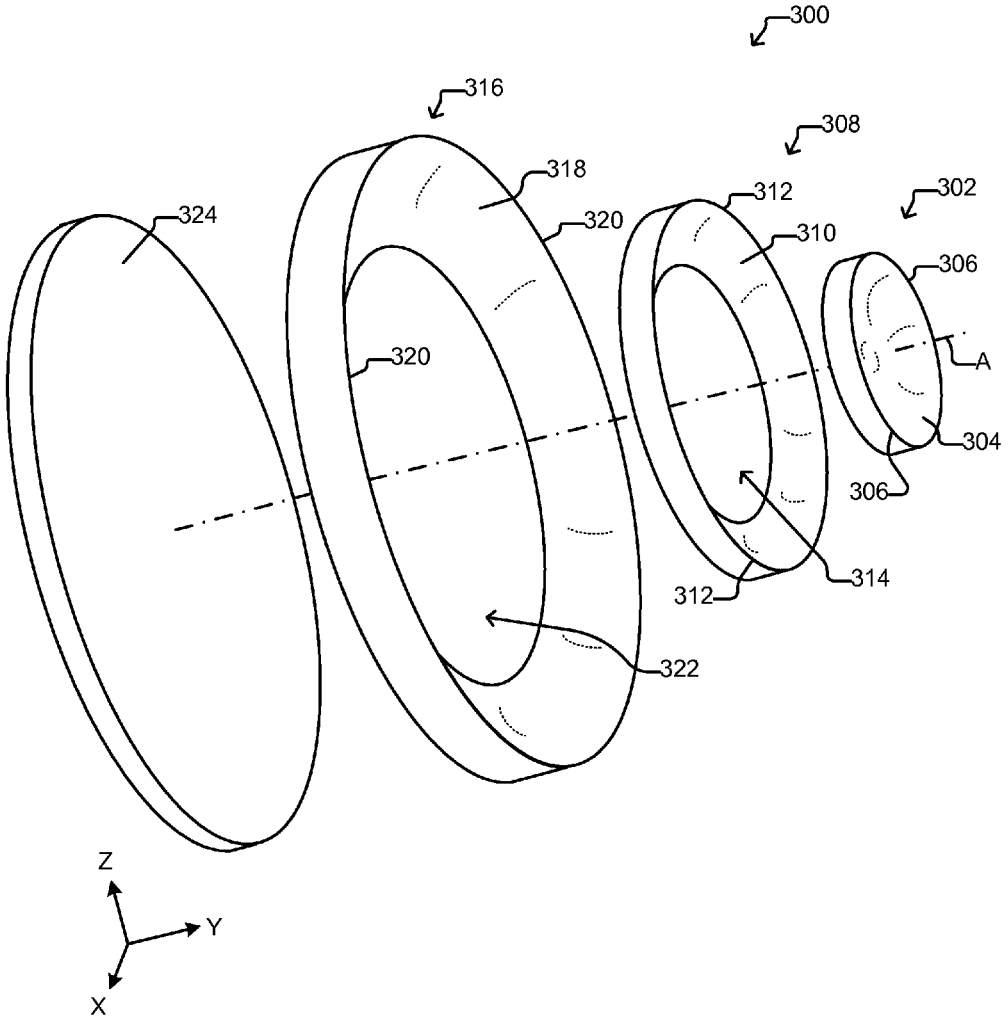
FIG. 3B is an exploded view of the stepped main reflector antenna of FIG. 3A.
Figure 3C:
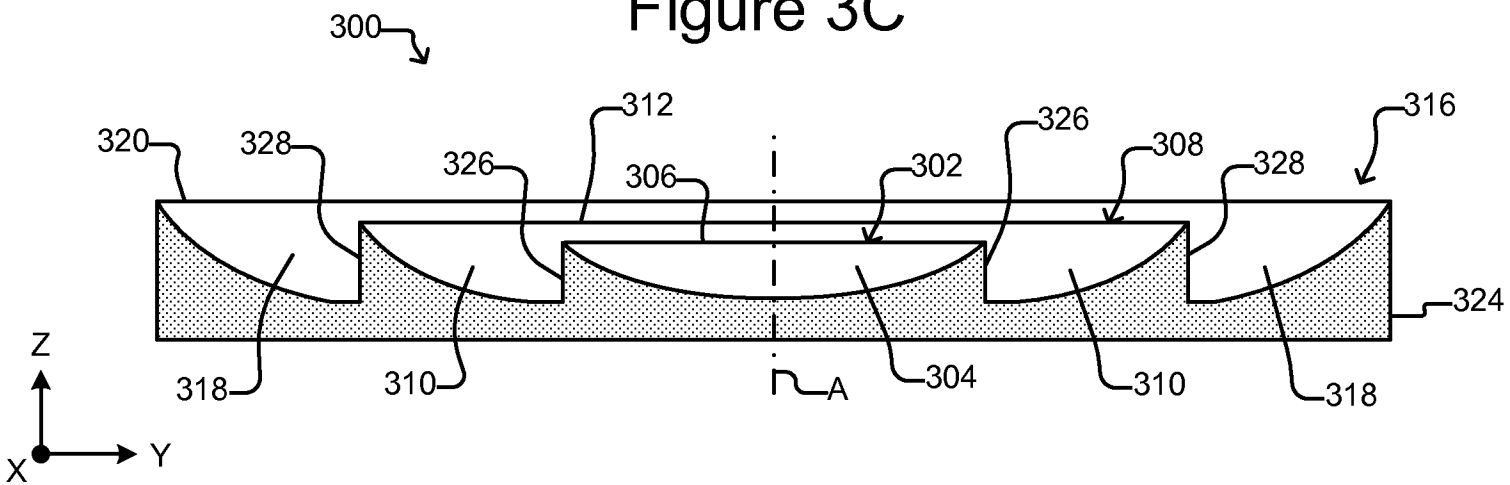
FIG. 3C is a cross-sectional, side view of the stepped main reflector antenna of FIG. 3A.

FIGS. 3A-3C illustrate an example of a stepped RF main reflector 300 according to some embodiments of the invention. As shown, the stepped main reflector 300 can comprise an inner RF reflector 302 and one or more annular RF reflectors 308 and 316. Although two such annular RF reflectors 308 and 316 are shown, there can be fewer (i.e., one) or more.

As shown, the inner reflector 302 can have a face 310 comprising an RF reflecting surface. The first annular reflector 308 can comprise an annular face 304 comprising an RF reflecting surface, and the second annular reflector 316 can similarly have an annular face 318 comprising an RF reflecting surface. As also shown, the inner reflector 302 can be disposed in the central opening 314 of the first annular reflector 308, which can be disposed in the central opening 322 of the second annular reflector 316. The inner reflector 302, first annular reflector 308, and the second annular reflector 316 can be aligned on an axis A, which can be the bore sight axis A of the stepped main reflector 300.

As shown, each of the inner reflector 302, the first annular reflector 308, and/or the second annular reflector 316 can be disposed on and or attached to a base structure 324. Alternatively, the opening 314 in the first annular reflector 308 can comprise a floor (not shown) to which the inner reflector 302 is attached, and/or the opening 322 in the second annular reflector 316 can comprise a floor (not shown) to which the first annular reflector 308 is attached. As yet another alternative, all or part of the stepped main reflector antenna 300 can be machined or cut from a single piece of material. As still another alternative, all or part of the stepped main reflector antenna 300 can be molded (e.g., formed in a mold).

As best seen in FIG. 3C, the outer sides 326 and 328 of the first annular reflector 308 and the inner reflector 302 can form steps 326 and 328. The steps 326 and 328 can be oriented substantially in the direction of the bore sight axis A. In some embodiments, the length of each step 326 and 328 parallel to the bore sight axis A can be approximately an integer (including one) multiple of a wavelength of an RF signal 418 (see FIG. 4A) to be transmitted and/or received by the stepped main reflector antenna 300.

Figure 4A:
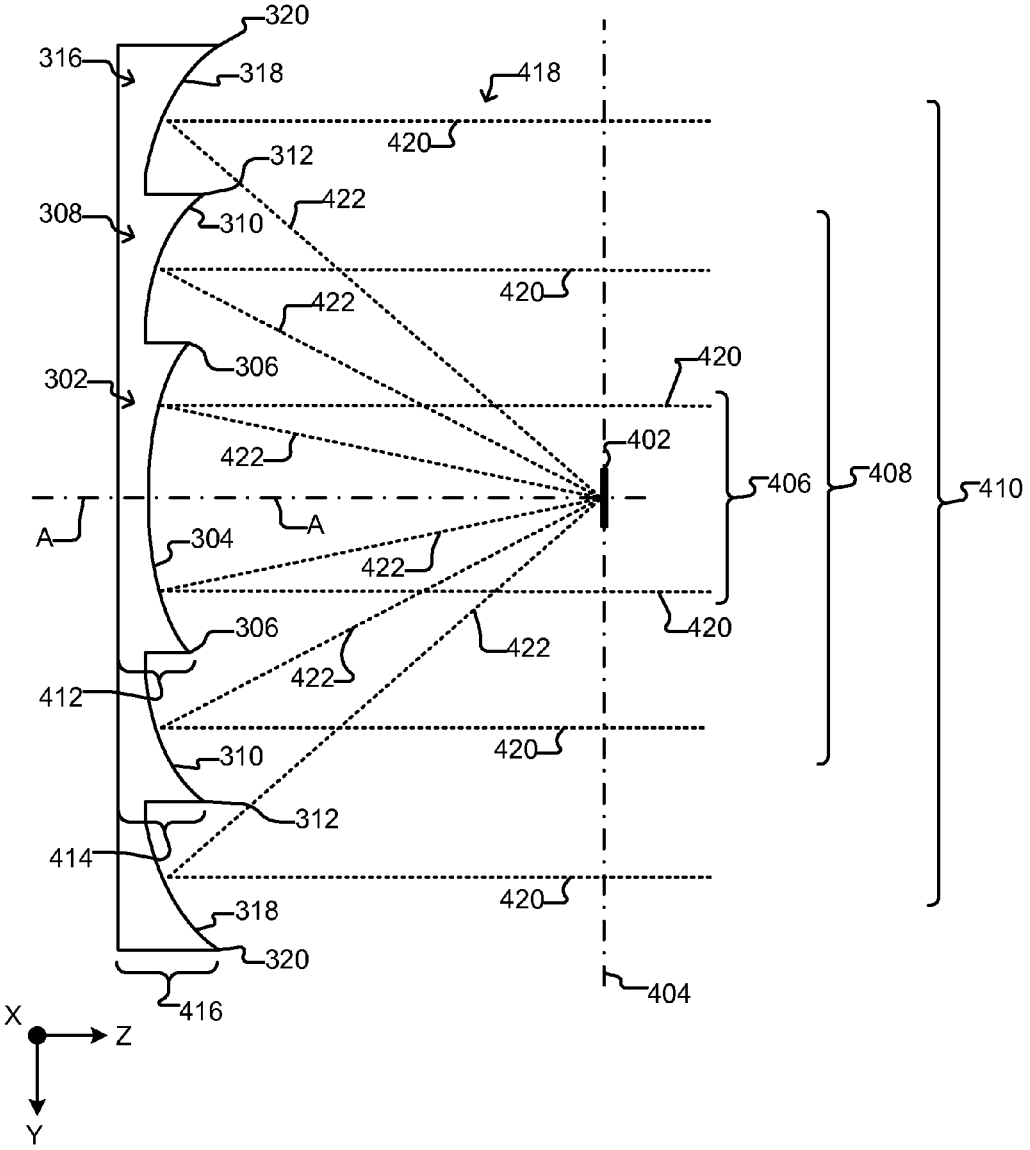
FIGS. 4A and 4B are side views of a profile of the stepped main reflector antenna of FIGS. 3A-3C highlighting particular dimensions according to some embodiments of the invention.

As illustrated in FIG. 4A (which shows a profile of a cross section of the stepped main reflector antenna 300), the face 304 of the inner reflector 302 can be shaped and positioned to reflect an RF signal 418 between the inner reflector 302 and a focal area 402 in a focal plane 404. As illustrated in and will be discussed with respect to FIG. 5, the focal area 402 can be, for example, on a secondary RF reflector 504 (not shown in FIG. 4A). The segments of the RF signal 418 between the face 304 and the focal area 402 are labeled 422 in FIG. 4A, and the segments of the RF signal 418 between face 304 and space are labeled.

As mentioned, the face 304 of the inner reflector 302 can be shaped and positioned to reflect an RF signal 418 between the inner reflector 302 and a focal area 402. For example, the curvature of the face 304 can be such that an incoming RF signal 418 (e.g., from a remotely located transmitting antenna (not shown)), is reflected from the face 304 to the focal area 402. The curvature of the face 304 can also reflect an outgoing RF signal 418 (e.g., to be transmitted to a remote receiving antenna (not shown)) from the focal area 402 into space. In some embodiments, the curvature of the face 304 can be such that the segments 420 of the RF signal 418 reflected away from the face 304 are generally parallel such that the RF signal 418 is a directed or parallel beam signal. As shown, the inner reflector 302 has an RF aperture 406.

Still referring to FIG. 4A, the annular face 310 of the first annular reflector 308 can be shaped (e.g., have a curvature) and positioned to reflect portions of the RF signal 418 that are outside of the RF aperture 406 of the inner reflector 302 between the first annular reflector 308 and the focal area 402. As can be seen, the RF aperture 408 of the combination of the first annular reflector 308 and the inner reflector 302 can be larger than the RF aperture 406 of the inner reflector 302. The first annular reflector 308 can thus effectively increase the RF aperture of the inner reflector 302. Moreover, although the depth 414 of the first annular reflector 308 can be larger than the depth 412 of the inner reflector 302, the depth 414 of the first annular reflector 308 can be smaller than the depth of the inner reflector 302 were the inner reflector 302 to be increased in size to achieve the RF aperture 408. The combination of the first annular reflector 308 and the inner reflector 302 can thus have an RF aperture 408 of a given size while having a depth 414 that is smaller than the depth of a single reflector (e.g., like inner reflector 302) having a comparably sized RF aperture.

Figure 4B:
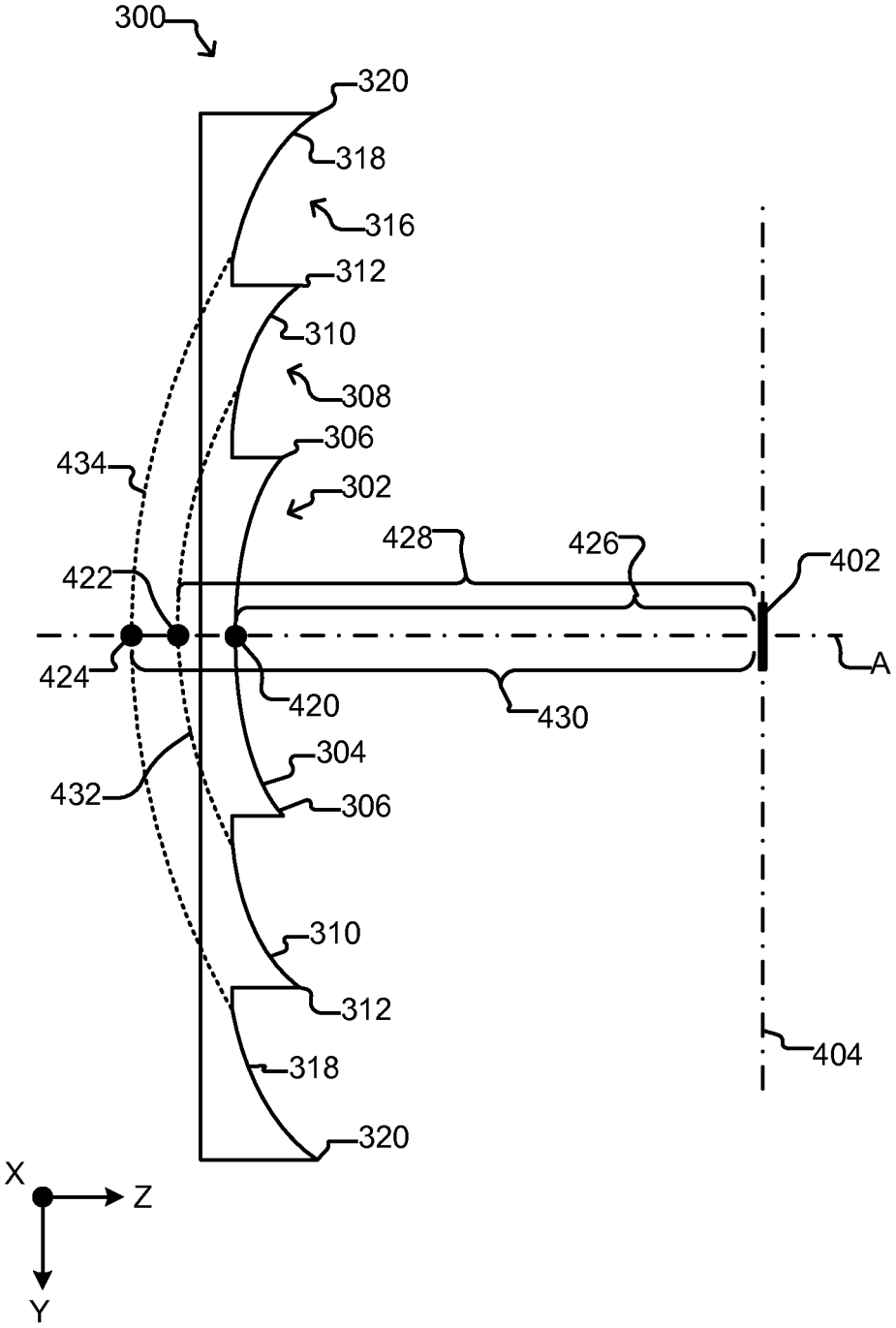

The "front" of the stepped main reflector antenna 300 faces the focal area 402 and thus is to the right of the stepped main reflector antenna 300 in FIGS. 4A and 4B. The "back" of the stepped main reflector antenna 300 is opposite the front and thus is to the left of the stepped main reflector antenna 300 in FIGS. 4A and 4B. The term "depth," as used herein, means the distance from the back of the stepped main reflector antenna 300 to an outer edge 306, 312, 320 of one of the inner reflector 302, the first annular reflector 308, or the second annular reflector 316 in a direction that is parallel to the bore sight axis A. The depth 412 of the inner reflector 302 in FIG. 4A is thus the distance from the back of the stepped main reflector antenna 300 to the outer edge 306 of the inner reflector 302 in a direction that is parallel to the bore sight axis A. Likewise, the depth 414 of the first annular reflector 306 is the distance from the back of the stepped main reflector antenna 300 to the outer edge 312 of the first annular reflector 308 in a direction that is parallel to the bore sight axis A. Similarly, the depth 416 of the second annular reflector 316 is thus the distance from the back of the stepped main reflector antenna 300 to the outer edge 320 of the second annular reflector 316 in a direction that is parallel to the bore sight axis A.

The second annular reflector 316 can likewise increase the RF aperture with only a corresponding small increase in the depth of the stepped main reflector antenna 300. As shown in FIG. 4A, the annular face 318 of the second annular reflector 316 can be shaped (e.g., have a curvature) and positioned to reflect portions of the RF signal 418 that are outside of the RF aperture 408 of the inner reflector 302 and the first annular reflector 308 between the second annular reflector 316 and the focal area 402. As can be seen, the RF aperture 410 of the combination of the second annular reflector 316, the first annular reflector 308, and the inner reflector 302 can be larger than the RF aperture 408 of the combination of the first annular reflector 308 and the inner reflector 302. The second annular reflector 316 can thus effectively further increase the RF aperture of the inner reflector 302. Moreover, although the depth 416 of the second annular reflector 316 can be larger than the depth 414 of the first annular reflector 308 and the depth 412 of the inner reflector 302, the depth 416 of the second annular reflector 316 can be smaller than the depth of the inner reflector 302 were the inner reflector to be increased in size to achieve the RF aperture 410. The combination of the second annular reflector 416, the first annular reflector 308, and the inner reflector 302 can thus have an RF aperture 410 of a given size while having a depth 416 that is smaller than the depth of a single reflector (e.g., like inner reflector 302) having a comparably sized RF aperture.

In some embodiments, the stepped main reflector antenna 300 can be a pseudo-parabolic reflector. In such embodiments, the inner reflector 302 can be a parabolic RF reflector antenna. The face 310 of the first annular reflector 308 and the face 318 of the second annular reflector 316 can each be an annular, outer portion of parabolic RF reflector antennas.

FIG. 4B illustrates how the stepped main reflector 300 of FIGS. 3A-4A can be so configured.

As shown, the face 304 of the inner reflector 302 can comprise a substantially paraboloidal surface with a vertex 420 (i.e., the innermost point at the center of the face 304). The face 310 of the first annular reflector 308 can be an annular, outer portion of what would otherwise be a paraboloidal surface 432 with a vertex 422, and the face 318 of the second annular reflector 316 can similarly be an annular, outer portion of what would otherwise be a paraboloidal surface 434 with a vertex 424. Moreover, the inner reflector 302, the first annular reflector 308, and the second annular reflector 316 can be aligned on the bore sight axis A, as shown, such that the vertexes 420, 422, and 424 are substantially aligned on the bore sight axis A. In addition, the vertexes 422 and 424 of one or both of the first annular reflector 308 and/or the second annular reflector 316 can be disposed behind the stepped main reflector antenna 300, where the focal area 402 is located in front of the stepped main reflector antenna 300. That is, the vertex 422 of the first annular reflector 308 and/or the vertex 424 of the second annular reflector 316 can be on the opposite side of the stepped main reflector antenna 300 from the focal area 402 and thus the focal plane 404.

The focal lengths 426, 428, and 430 of the inner reflector 302, the first annular reflector 308, and the second annular reflector 316, respectively, are shown in FIG. 4B. As shown, the focal length 430 of the second annular reflector 316 can be longer than the focal length 428 of the first annular reflector 308, which can be longer than the focal length 426 of the inner reflector 302. Yet, as noted, each of the inner reflector 302, the first annular reflector 308, and the second annular reflector 316 can have substantially the same focus. That is, each of the inner reflector 302, the first annular reflector 308, and the second annular reflector 316 can focus an RF signal 418 to substantially the same focal area 402 on substantially the same focal plane 404.

As shown, the focal area 402 can be on a focal plane 404. In some embodiments, the focal area 402 can be centered on the bore sight axis A. That is, the bore sight axis A can pass through a center of the focal area 402. In embodiments in which the inner reflector 302 is a parabolic reflector and the first and second annular reflectors 308 and 316 are outer portions of what are otherwise parabolic reflectors, the focal area 402 can be generally circular.

Figure 5:
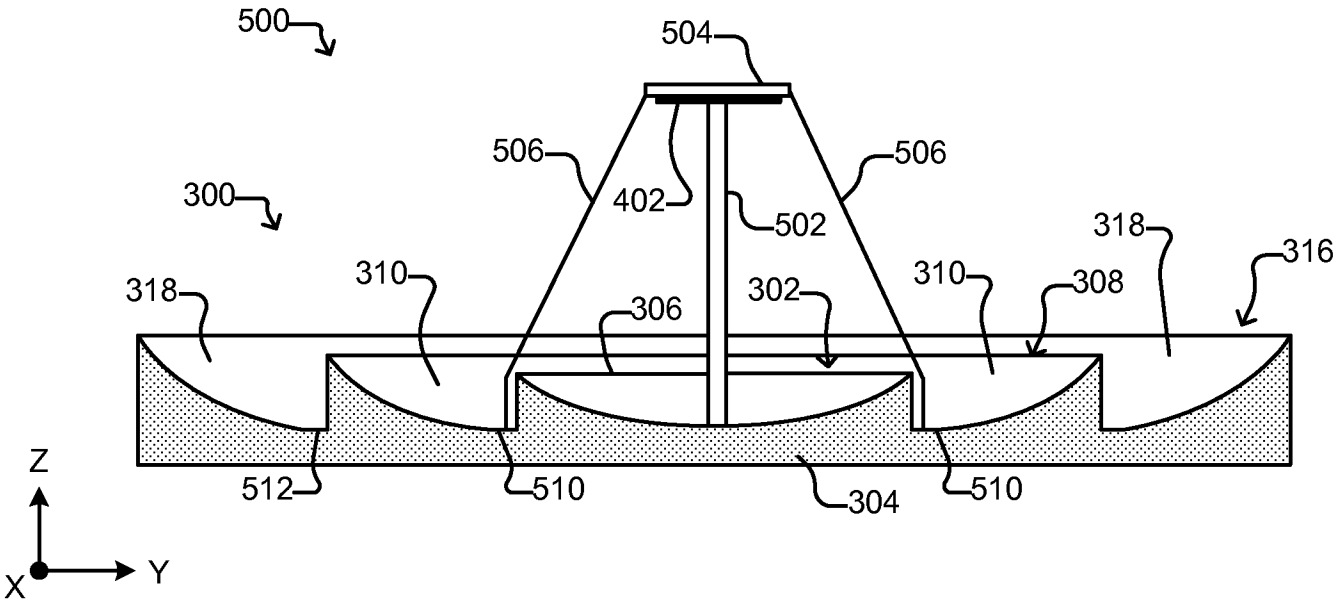
FIG. 5 shows an example of an RF antenna system of which the stepped main reflector antenna of FIGS. 3A-3C is a part according to some embodiments of the invention.

As shown in FIG. 5, the stepped main reflector antenna 300 can be part of a reflector antenna system 500 according to some embodiments of the invention. As shown, a secondary RF reflector 504 (e.g., an RF sub-reflector) can be attached to the stepped main reflector antenna 300 by support structures 506 (e.g. struts). As shown, the support structures 506 can be attached to the stepped main reflector antenna 300, for example, at locations 510 between the face 310 of the first annular reflector 308 and the inner reflector 302. As another example, the support structures 506 can be attached to the stepped main reflector antenna 300 at locations 512 between the face 318 of the second annular reflector 316 and the first annular reflector 308. The locations 510 and/or 512 can be in RF shadow regions that are blocked such that the locations 510 and/or 512 do not receive or reflect the RF signal 418.

The secondary reflector 504 can be an RF reflecting antenna, and an RF signal feed 502 can provide RF signals (e.g., RF signal 418) to and from the secondary reflector 504. For example, the secondary reflector 504 can be an RF splash plate. As another example, the secondary reflector 504 can be a parabolic RF reflector antenna disposed in a Gregorian configuration or a Cassegrain configuration. As yet another example, the secondary reflector 504 can instead by an RF horn antenna or the like.

The stepped main reflector antenna 300 and similar such stepped main reflector antennas can be used in a variety of applications. For example, the stepped main reflector antenna 300 can be part of a standalone transmitting, receiving, or transceiving antenna (e.g., like antenna system 500) in a wireless communication system. As another example, the stepped main reflector antenna 300 can be part of a transmitting, receiving, or transceiving antenna (e.g., like antenna system 500) that is mounted on an aircraft, a space craft, a satellite, a mobile ground vehicle, or the like.

The stepped main reflector antenna 300 illustrated in FIGS. 3A-5 is an example only, and many variations are possible.

Figure 6:
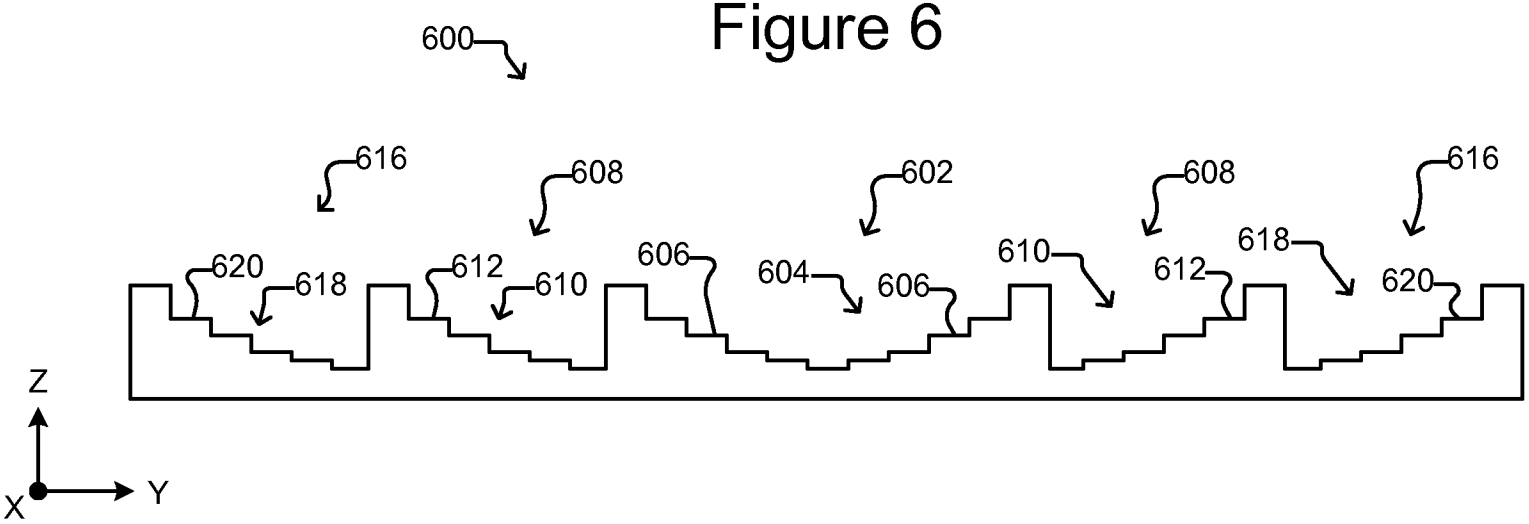
FIG. 6 shows an example of a stepped main reflector RF antenna in which reflective surfaces comprise discrete steps according to some embodiments of the invention.

For example, the faces 304, 310, and 318 of the inner reflector 302, first annular reflector 308, and second annular reflector 316 need not be smooth as illustrated in FIGS. 3A-5. FIG. 6 illustrates example of an embodiment of a stepped main reflector RF antenna 600 in which faces 604, 610, and 618 comprise discrete steps. The RF antenna 600 can replace the RF antenna 300 in any of FIGS. 3A-5.

Similar to the stepped main reflector antenna 300 discussed above, the stepped main reflector 600 can comprise an inner RF reflector 602 disposed in an opening of a first annular RF reflector 608. A second annular RF reflector 616 can be disposed in an opening in the first annular RF reflector 608.

The inner reflector 602 can have a face 604 comprising an RF reflecting surface. As shown, the face 604 can comprise a plurality of discrete steps 606, which can be small enough to approximate a smooth surface for the face 604. Otherwise, the inner reflector 602 can be like the inner reflector 302 as discussed above.

The first annular reflector 608 can have an annular face 610 comprising an RF reflecting surface. As shown, the face 610 can comprise a plurality of discrete steps 612, which can be small enough to approximate a smooth surface for the face 610. Otherwise, the first annular reflector 608 can be like the first annular reflector 308 as discussed above.

The second annular reflector 616 can have an annular face 618 comprising an RF reflecting surface. As shown, the face 618 can comprise a plurality of discrete steps 620, which can be small enough to approximate a smooth surface for the face 618. Otherwise, the second annular reflector 616 can be like the second annular reflector 316 as discussed above.

Surfaces comprising discrete steps, like steps 606, 612, and 620, can in some embodiments, facilitate manufacturability of the stepped main reflector antenna 600.

Another example of a variation of the stepped main reflector antenna 300 is that the antenna 300 can have more or fewer than two annular reflectors 308 and 316. That is, as noted above, the stepped main reflector antenna 300 can comprise additional annular reflectors (not shown) similar to annular reflectors 308 and 316. Each additional annular reflector (not shown) can be larger than a previous annular reflector so that the additional annular reflector (not shown) fits into a central opening of the previous annular reflector in the same way that the first annular reflector 308 fits into the central opening 322 of the second annular reflector 316 as shown in FIGS. 3A-3C. As also noted, the stepped main reflector antenna 300 need not include the second annular reflector 316.

These and other modifications can be made to the stepped main reflector 300 as well as the stepped main reflector 600 discussed above. Thus, although specific embodiments and applications of the invention have been described in this specification, these embodiments and applications are exemplary only, and many variations are possible.

We claim:

1. A radio frequency (RF) reflector antenna system comprising:

an inner RF reflector antenna comprising an RF reflecting surface having a first focal length to a focal plane;

one or more annular RF reflector antennas each comprising an annular RF reflecting surface having a focal length to said focal plane, wherein:

said inner reflector is disposed in a central opening of a first one of said one or more annular reflector antennas, said first annular reflector antenna having a first annular RF reflecting surface and a second focal length to said focal plane, said first focal length is different than said second focal length, and an outer edge of said first annular RF reflecting surface is closer to said focal plane than an outer edge of said RF reflecting surface of said inner RF reflector antenna, said reflecting surface of said inner RF reflector antenna is shaped to reflect an RF signal to a focal area on said focal plane, and said first annular reflecting surface is shaped to reflect said RF signal to said focal area on said focal plane; and a secondary reflector antenna comprising said focal area, said secondary reflector antenna spaced from said inner reflector antenna and said first annular reflector antenna; and supports attaching said secondary reflector antenna to said annular RF reflecting surface of one of said one or more annular antennas at an RF shadow region of said annular RF reflecting surface.

2. The reflector antenna system of claim 1, wherein said reflecting surface of said inner reflector is a paraboloidal surface.

3. The reflector antenna system of claim 2, wherein said first annular reflecting surface is an outer portion of a paraboloid.

4. The reflector antenna system of claim 3, wherein a vertex of said reflecting surface of said inner reflector and a vertex of said paraboloidal of said first annular reflecting surface are on a same axis.

5. The reflector antenna system of claim 4, wherein:

said first focal length is from said vertex of said reflecting surface of said inner reflector to said focal plane, and said second focal length is from said vertex of said paraboloidal of said outer portion to said focal plane.

6. The reflector antenna system of claim 5, wherein said second focal length is longer than said first focal length.

7. The reflector antenna system of claim 1, wherein said one or more annular reflecting antennas further comprise a second annular RF reflector antenna comprising a second annular RF reflecting surface having a third focal length to said focal plane, wherein:

said first annular reflector antenna is disposed in a central opening of said second annular reflector antenna, and said third focal length is different than said first focal length.

8. The reflector antenna system of claim 7, wherein said third focal length is different than said second focal length.

9. The reflector antenna system of claim 7, wherein:

said second focal length is greater than said first focal length, and said third focal length is greater than said second focal length.

10. The reflector antenna system of claim 7, wherein:

said reflecting surface of said inner reflector is paraboloidal, said first annular reflecting surface is an outer portion of a paraboloid, and said second annular reflecting surface is an outer portion of a paraboloid.

11. The reflector antenna system of claim 10, wherein a vertex of said reflecting surface of said inner reflector, a vertex of said paraboloidal of said first annular reflecting surface, and a vertex of said paraboloidal of said second annular reflecting surface are on a same axis.

12. The reflector antenna system of claim 7, wherein:

said reflecting surface of said inner RF reflector antenna is shaped to reflect an RF signal to a focal area on said focal plane, said first annular reflecting surface is shaped to reflect said RF signal to said focal area on said focal plane, and said second annular reflecting surface is shaped to reflect said RF signal to said focal area on said focal plane.

13. The reflector antenna system of claim 1, wherein an RF aperture of said inner reflector and said first annular reflector antenna in combination is larger than an RF aperture of said inner reflector.

14. The reflector antenna system of claim 1, wherein a first distance substantially parallel to a bore sight axis of said reflector antenna system from said outer edge of said RF reflecting surface of said inner RF reflector antenna to a common surface is less than a second distance substantially parallel to said bore sight axis from said outer edge of said first annular RF reflecting surface to said common surface.

15. The reflector antenna system of claim 14, wherein said common surface is a plane that is substantially perpendicular to said bore sight axis.

16. The reflector antenna system of claim 1, wherein a step between said outer edge of said RF reflecting surface of said inner RF reflector antenna and an inner edge of said first RF reflecting surface of said first annular RF reflector antenna is substantially parallel to a bore sight axis of said reflector antenna system.

17. The reflector antenna system of claim 1, wherein said RF shadow region is blocked from receiving RF energy from or reflecting RF energy to said focal area.

18. The reflector antenna system of claim 17 further comprising:

a step between an inner edge of said RF reflecting surface of said one of said annular reflecting antennas and either an outer edge of an annular reflecting surface of another one of said annular reflecting antennas or said outer edge of said reflecting surface of said inner reflector antenna, wherein said step blocks said shadow region from receiving said RF energy from or reflecting said RF energy to said focal area.

19. The reflector antenna system of claim 1, wherein said RF shadow region is proximate an inner edge of said annular reflecting surface of said one of said one or more annular antennas.

20. A radio frequency (RF) reflector antenna system comprising:

an inner RF reflector antenna comprising an RF reflecting surface having a first focal length to a focal plane; and a first annular RF reflector antenna comprising a first annular RF reflecting surface having a second focal length to said focal plane, wherein:

said inner reflector is disposed in a central opening of said annular reflector antenna, said first focal length is different than said second focal length, and an outer edge of said first annular RF reflecting surface is closer to said focal plane than an outer edge of said RF reflecting surface of said inner RF reflector antenna, wherein:

said reflecting surface of said inner reflector antenna consists essentially of a plurality of discrete steps sufficiently small to approximate a smooth surface, and said first annular reflecting surface consists essentially of a plurality of discrete steps sufficiently small to approximate a smooth surface.

* * * * *